US010245630B2

(12) United States Patent
Fischer et al.

(10) Patent No.: US 10,245,630 B2
(45) Date of Patent: Apr. 2, 2019

(54) SMART FIXTURE DISTORTION CORRECTION SYSTEM

(71) Applicant: Caterpillar Inc., Peoria, IL (US)

(72) Inventors: Tyler Fischer, Peoria, IL (US); George Mathai, Peoria, IL (US); Nien Lee, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 853 days.

(21) Appl. No.: 14/844,384

(22) Filed: Sep. 3, 2015

(65) Prior Publication Data

US 2017/0066024 A1 Mar. 9, 2017

(51) Int. Cl.

| | |
|---|---|
| ***B21D 5/02*** | (2006.01) |
| ***B21D 3/10*** | (2006.01) |
| ***B21D 22/20*** | (2006.01) |
| ***B21D 5/00*** | (2006.01) |

(52) U.S. Cl.

CPC ..... *B21D 3/10* (2013.01); *B21D 5/006* (2013.01); *B21D 5/02* (2013.01); *B21D 22/20* (2013.01)

(58) Field of Classification Search

CPC ..... B21D 22/20; B21D 5/02; B21D 5/006; B21D 3/10

USPC ..... 72/6

See application file for complete search history.

(56) References Cited

U.S. PATENT DOCUMENTS

| | | | | |
|---|---|---|---|---|
| 3,713,312 | A | 1/1973 | Galdabini | |
| 3,943,746 | A | 3/1976 | Eitel et al. | |
| 3,948,076 | A | 4/1976 | Eitel et al. | |
| 4,144,730 | A | 3/1979 | Judge, Jr. | |
| 4,154,073 | A * | 5/1979 | Galdabini | B21D 3/10 72/16.2 |
| 4,306,435 | A * | 12/1981 | Galdabini | B21D 3/10 72/16.2 |
| 4,408,471 | A * | 10/1983 | Gossard | B21D 5/006 700/206 |
| 4,802,357 | A * | 2/1989 | Jones | B21D 5/02 700/165 |
| 5,209,153 | A | 5/1993 | Araki et al. | |
| 8,020,418 | B2 * | 9/2011 | Suzuki | B21D 22/20 72/16.1 |
| 8,601,659 | B2 | 12/2013 | Prevey et al. | |
| 2014/0007394 | A1 | 1/2014 | Haas et al. | |

* cited by examiner

*Primary Examiner* — David B Jones
(74) *Attorney, Agent, or Firm* — Miller, Matthias & Hull

(57) ABSTRACT

A distortion correction tool corrects distortion in a workpiece held by a fixture. Sensors in the fixture determine the existence, extent, and location of distortions in the workpiece and a controller directs the application of the distortion correction tool to the workpiece based on the information received from the sensors. Particularly, a ram mounted to a quick-change tool head for a robotic arm is used as a distortion correction tool to correct distortions in a workpiece by inducing plastic deformation through use of compressive force, the extent and location of which is determined by a controller based on sensor measurements.

20 Claims, 5 Drawing Sheets

202
204
HOLD WORKPIECE
PREPARE FIXTURE
START
200
208
SET DISTORTION TOLERANCE
212
APPLY FORCE TO WORKPIECE
216
GENERATE SENSOR MEASUREMENT
YES
220
ADDITIONAL FORCE?
NO
244
224
OUTSIDE OF TOLERANCE?
NO
END
YES
228
DETERMINE CORRECTIVE FORCE NECESSARY TO CORRECT DISTORTION
232
SELECT CORRECTION TOOL
236
APPLY CORRECTIVE FORCE

SMART FIXTURE DISTORTION CORRECTION SYSTEM

TECHNICAL FIELD

This patent disclosure relates generally to detecting distortion introduced into workpieces through manufacturing processes and correcting the distortion, and more particularly, to a smart fixture system for dynamically monitoring and correcting these distortions, which may include correction through use of a robot arm with a quick-change tool head.

BACKGROUND

Manufacturing and industrial processes introduce distortion into workpieces resulting in the workpieces being rejected by quality control inspectors and customers, requiring reworking or resulting in the workpiece being scrapped. Additionally, if not reworked, workpieces distorted beyond tolerances may potentially fail when in use. Scrap is an inefficient outcome for parts, and failure may result in additional losses resulting from the time equipment is offline as a result of the failure, any additional damage caused to other parts and equipment by the failure, and any safety hazards caused by the failure. Furthermore, incremental costs, such as tool and labor costs, rise due to the ultimately unproductive operation of the manufacturing equipment. To prevent failure, manufacturers rely on quality control processes to reject parts outside of tolerances. However, these processes are time-consuming, divorced from the manufacturing process, and may rely on unreliable or inconsistent detection methods.

United States Patent Publication 2014/0007394 ("US '394"), entitled "Method and Compression Apparatus for Introducing Residual Compression into a Component Having a Regular or an Irregular Shaped Surface," purports to address the problem of component failure from high-stressed areas. US '394 describes an impact tool head used to induce compression in workpieces having an irregular surface. The design of US '394, however, may not effectively detect and evaluate irregularities and is limited in its ability to do so, may not make accurate decisions regarding the corrective force to be applied, and only narrowly addresses distortion through an inefficient correction process using non-selective guidance. Accordingly, there is a need for improved systems, apparatuses, and methods for distortion detection and correction.

SUMMARY

In one aspect, the disclosure describes a smart fixture distortion correction system. The smart fixture distortion correction system includes a fixture with a sensor component of one or more sensors. The sensor component is in communication with a controller, providing the controller with measurements of forces applied to a workpiece retained by the fixture, the extent of any distortion of the workpiece, and the location of any distortion of the workpiece. The controller determines the amount of force and location of the force needed to be applied to the workpiece to correct any distortion. The smart fixture distortion correction system also includes a correction tool in communication with the controller, which directs the application of the correction tool to the workpiece.

In another aspect, the disclosure describes a method of correcting distortions in a workpiece in a smart fixture distortion correction system. The method provides, responsive to the application of a process force to a workpiece held by a fixture, sensing, by a sensor component operatively coupled to the fixture, a first measurement of the workpiece held by the fixture, the first measurement comprising a magnitude of the process force, sensing, by the sensor component, a second measurement of the workpiece, the second measurement comprising a magnitude of a distortion of the workpiece induced by the process force, determining, by a controller communicatively coupled to the sensor, that the second measurement is not within a tolerance level, selecting, by the controller, based on the first measurement, a correction tool for bringing the distortion within the distortion tolerance, and directing, by the controller, the correction tool to apply a first corrective force to the workpiece, wherein the magnitude of the first corrective force is determined based on the first measurement.

In another aspect, the disclosure describes a computer-readable storage medium comprising executable instructions that when executed by a processor cause the processor to effectuate operations comprising receiving, from a sensor component operatively coupled to a fixture, a first measurement of a workpiece held by the fixture, wherein the first measurement comprises a first indication of a volumetric distortion of a first location of the workpiece, and wherein the first measurement is generated responsive to a weld of the workpiece, determining that the first measurement is not within a tolerance, and responsive to determining that the first measurement is not within the tolerance, directing a correction tool in communication with the controller to apply a compressive force to the first location, the magnitude of the force based on the volumetric displacement of the first location.

DETAILED DESCRIPTION

Figure 1:
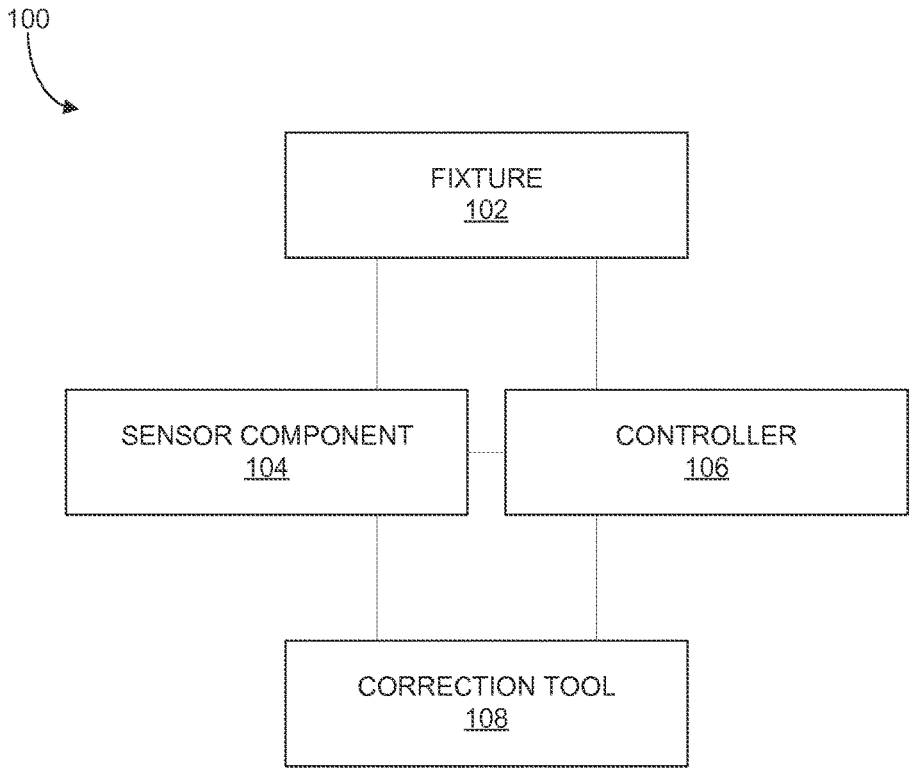
FIG. 1 is an exemplary illustration of a smart fixture distortion correction system.

Now referring to the drawings, wherein like reference numbers refer to like elements, there is illustrated in FIG. 1 smart fixture distortion correction system 100. System 100 may include fixture 102, which may also be referred to as a workholding or tooling. Fixture 102 may comprise a single body or multiple bodies which may maintain a positional relationship and alignment between a workpiece and a tool. Whether a single body or multiple bodies, fixture 102 is not limited to any particular geometry, and may comprise multiple shapes. Furthermore, fixture 102 is not limited to any particular size, weight, or form. Fixture 102 is not limited to any particular material (such as steel or aluminum) or material type (such as ferrous or non-ferrous material), and may comprise one or more materials or material types. Fixture 102 may be single-purpose or multipurpose, and may support and hold workpieces of a single type or dimensions or multiple types and dimensions. Fixture 102 may be modular. Accordingly, workpieces may be mated with fixture 102 in a variety of ways, and fixture 102 is not limited by the types of workpiece surfaces it may locate, support, and hold. Fixture 102 may comprise locating structures, such as pins and bushings, and support structures, such as stops and channels. This may involve, for example, a variety of points of contact of the same type or mixed types. Fixture 102 may restrict movement of a workpiece in one or more axes or directions of motion.

System 100 may include sensor component 104. Sensor component 104 may include one or more sensors. For example, sensor component 104 may be one or more of, but is not limited to, a load cell, such as a hydraulic or strain gauge load cell, a temperature sensor, an actuator, a force sensor, a gas sensor, an accelerometer, a distance sensor, a linear position sensor, a rotary position sensor, etc. Sensor component 104 may also comprise multiple sensor functions in combination. For example, sensor component 104 may comprise a load cell and a temperature sensor, or sensor component 104 may comprise a combined load cell and temperature sensor. As another example, sensor component 104 may comprise a load sensor, a temperature sensor, and, additionally, a combination load-temperature sensor. Sensor component 104 may comprise multiple sensors in direct or indirect, unidirectional or bidirectional communication with each other. As an example, a subset of sensors comprising sensor component 104 may be in communication with each other, while another subset is not. For example, a subset of sensors arranged by type (i.e., load cells) may be in communication without communication with one or more temperature sensors. The temperature sensors in that example may be in communication with each other. As another example, a subset of sensors grouped by location may be in communication with each other.

Sensor component 104 may comprise one or more sensors (or one or more sensor functions where multiple sensor functions are in combination) for particular processes. For example, fixture 102 may be a multipurpose fixture used for multiple operations performed on the relevant workpiece. In one exemplary aspect, fixture 102 may be a fixture for a workpiece through an entire production line. For example, fixture 102 may retain a workpiece for a production line of a particular part. In this example, fixture 102 is used to locate and support the workpiece through each process in the production line to produce a from the workpiece.

Sensor component 104 may be integral to fixture 102. For example, a sensor of sensor component 104 may be partially, substantially, or entirely enclosed within a body of fixture 102. Sensors of sensor component 104 may also be external to the body or bodies comprising fixture 102. For example, a sensor of sensor component 104 may be a fixed or movable part of fixture 102. In one exemplary aspect, a sensor of sensor component 104 may be affixed to or integral to a locating structure of fixture 102 such as, for example, a bushing or pin. In another exemplary aspect, a sensor of sensor component 104 may be affixed to or integral to a support structure, such as a J-channel or U-channel. For example, sensor component 104 may comprise a load cell. The load cell may be System 100 may include controller 106 communicatively connected to sensor component 104. The connection between controller 106 and sensor component 104 may be a direct or indirect, wired or wireless connection. The connection may be dedicated or shared, continuous or on-demand. For example, a connection between sensor component 104 and controller 106 may be established based on a predetermined schedule. As another example, a connection between sensor component 104 and controller 106 may be established when a certain external condition is met.

System 100 may be part of a manufacturing system. For example, a manufacturing system may include, but is not limited to, one or more subsystems, such as a machining subsystem, a joining subsystem, an additive manufacturing subsystem, a forming subsystem, a molding subsystem, a casting subsystem, a shaping subsystem, an assembly subsystem, a welding subsystem, a soldering subsystem, a cooling subsystem, a heat treating subsystem, or a finishing subsystem. These subsystems may overlap in one or more capabilities or purposes, or may be entirely redundant. These subsystems may involve one or more processes which include the application of a force to a workpiece. System 100 may be in unidirectional or bidirectional communication with, control, be under the control of, or be entirely isolated from one or more other subsystems. For example, system 100 may be part of a welding subsystem. In this example, a welding force may be applied to a workpiece retained by fixture 102.

Figure 2:
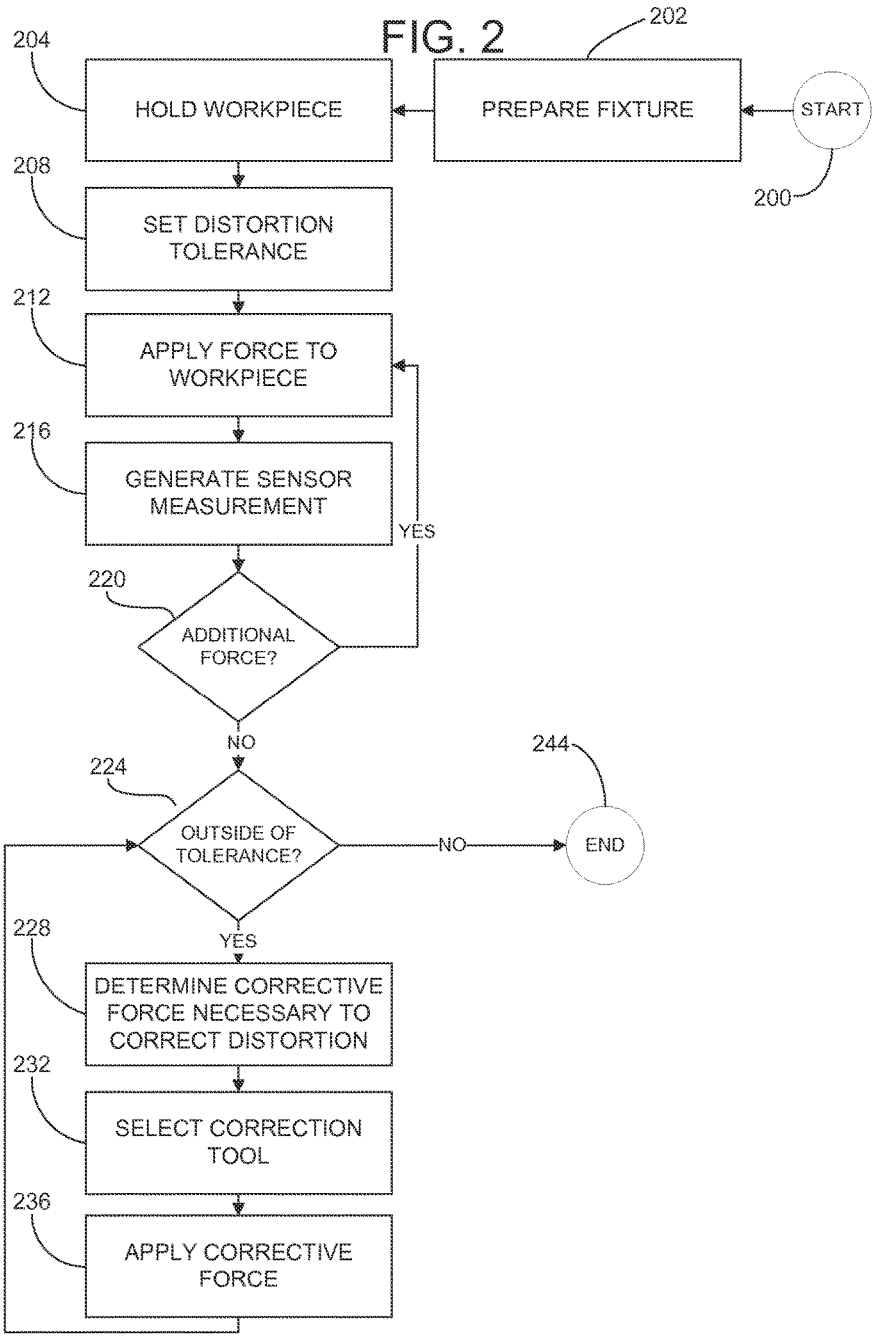
FIG. 2 is an exemplary method of correcting distortions in a workpiece in a smart fixture correction distortion system.

FIG. 2 illustrates an exemplary flowchart of a method of correcting distortions in a workpiece, for example, in smart fixture correction distortion system 100. At 202, fixture 102 is prepared. Preparation may comprise configuring fixture 102 to retain and support a particular workpiece or a particular type of workpiece. Preparation may also comprise removing or ejecting a currently retained workpiece from fixture 102. Preparation may also comprise configuring sensor component 104. At 204, the workpiece is held in fixture 102. This may occur before one or more processes have been performed involving the workpiece or after the workpiece has undergone one or more processes. For example, fixture 102 may receive the workpiece after the workpiece has been through a machining process but prior to (or in anticipation of) a welding process. This may include, but is not limited to, aligning the workpiece with fixture 102, engaging one or more retention mechanisms or locating structures, testing the integrity of the hold, ensuring proper fitup, and testing sensor component 104.

At 208, a distortion tolerance is set. This may occur prior to 202 and 204, such that a tolerance has already been set by controller 106. A tolerance may be set for a single workpiece, multiple workpieces, one or more types of workpieces, or for workpieces based on certain features. Multiple tolerances may be used for a single workpiece. For example, where there are multiple processes to be performed on a workpiece, different work areas may correspond to different tolerances. A distortion tolerance may be set for all sensors comprising sensor component 104, an individual sensor of sensor component 104, or a subset of sensors of sensor component 104. An initial benchmark measurement or zeroing measurement may be performed by sensor component 104 at 208.

The distortion tolerance may be determined by controller 106 using measurements from sensor component 104 or feedback from correction tool 108. For example, it may be determined by controller 106 that a distortion tolerance of a certain level results in too many operations of correction tool 108. In response, controller 106 may increase the distortion tolerance. Controller 106 may also adjust the distortion tolerance based on configuration of fixture 102. For example, controller 106 may adjust the distortion tolerance based on the configuration of locating structures on fixture 102. The configuration of locating structures may, for example, correspond to different components with different distortion tolerances.

As another example, controller 106 may receive distortion tolerances from fixture 102 through a radio-frequency identification (RFID) device or similar device utilizing wireless communications embedded on fixture 102. In one aspect, fixture 102 has a distortion correction identifier device. This device may comprise a device such as an RFID tag, a barcode, removable and associated with an individual workpiece. As a workpiece goes through a process or processes, the device may provide distortion tolerances. The distortion correction identifier may also provide instructions to controller 106 on the use or non-use of a particular type of tool or method for distortion correction. The distortion correction identifier may receive and store sensor measurements from sensor component 104 and controller 106 may provide the distortion correction identifier with information on what distortion correction was performed for the workpiece. The distortion correction identifier may be removable and may be used, for example, to provide a verification of the integrity of the workpiece. For example, when the workpiece is removed or ejected from fixture 102, the distortion correction identifier may be affixed to the component, packaging for the component, or otherwise associated with or accompanying the component. The distortion correction identifier may be encrypted such that controller 106 may provide certain information which is then unmodifiable and/or unreadable by controller 106. In one aspect, a distortion correction identifier is generated after the process or processes involving (potential and/or actual) distortion correction of the workpiece (i.e., at or after 244).

At 212, the workpiece is subject to a manufacturing or industrial process force. This force may be, for example, from a process such as a machining or welding process. At 206, distortion in the workpiece is determined using sensor component 104. Distortion may comprise, for example, deformation in the geometry of a part which exceeds a tolerance. In one aspect, a workpiece may have a geometric variation of ±5 mm, and any variance beyond that threshold would indicate distortion. For example, a workpiece may have a surface which is ideally flat or substantially flat. A tolerance of ±6 mm, for example, would indicate a distortion for areas of that surface where the workpiece surface deviates from the target level of the surface by more than 6 mm. While a bilateral tolerance is given as an exemplary tolerance, tolerances may also be unilateral. Tolerances may be expressed or calculated in any appropriate units and may also be expressed in terms of percentages.

As another example, a workpiece may have a straightness tolerance. This tolerance may be reflected, for example, in a centerline location. A zone may be used to set a tolerance. For example, the centerline may be required to be within a zone defining a certain diameter. For example, the centerline may be required to be within a zone 1 mm in diameter. Other characteristic tolerances may be, for example, circularity or cylindricity. As another example, a tolerance may be expressed through dimensional or spatial relationships between multiple workpieces. The tolerance may be expressed, for example, for angularity, perpendicularity, parallelism, coaxiality, or symmetry. For example, two parts to be fitted by an interference fit may have an allowance of 10 microns between two mating surfaces.

At 216, a sensor measurement is generated. The sensor measurement may comprise the magnitude of the force applied to the workpiece, the type of force applied to the workpiece, the extent of distortion (if any), and the location of distortion (if any). At 220, if another force is to be applied, the force is applied at 212 and a corresponding sensor measurement is generated. Dynamic monitoring of forces applied to a workpiece may accordingly be achieved.

At 224, the sensor measurement (or measurements) is checked against the distortion tolerance. If it is determined at that no distortion tolerance was exceeded, then it ends at 244.

If it is determined at 224 that the sensor measurement is outside of tolerance, then the corrective force necessary to correct the distortion is determined at 228. The amount of force to be applied to the workpiece to correct the distortion may be determined from the sensing of the force applied to the workpiece performed at 212. This may be accomplished using a correction tool. The correction tool may be a dedicated correction tool or may be selected from one or more sets of correction tools.

At 232, a correction tool is selected to apply the corrective force. The selected correction tool may depend on various factors, including, for example, the extent of the distortion as sensed at 216, the dimensions and geometry of the workpiece, the dimensions and geometry of fixture 102, the material of the workpiece, and the force or forces applied to the workpiece that introduced the distortion. The selection may also be a default selection.

At 208, corrective force is applied to the workpiece to bring the distortion back within tolerances. As corrective force is applied to the workpiece at 208, sensor component 104 may be used to detect how much force is being applied and how much correction is actually occurring. For example, if a part is geometrically deformed, sensor component 104 may be used to determine whether there is any corrective deformation in the workpiece being induced by the application of the corrective force. If there is no displacement in response to the force, too little displacement, or too much displacement, the force being applied may be adjusted accordingly. In this way, sensor component 104 may serve as a concurrent check allowing for concurrent adjustment and regulation of the correction tool and forces being applied.

Figure 3:
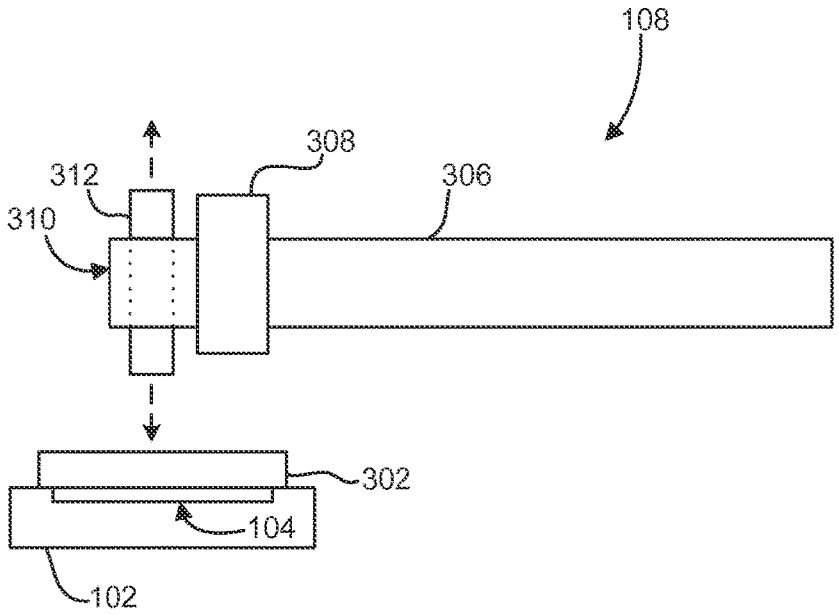
FIG. 3 is an exemplary illustration of a smart fixture distortion correction system.

FIG. 3 illustrates an exemplary smart fixture distortion correction system 100. Fixture 102 retains workpiece 302. Sensor component 104 senses forces applied to workpiece 302 and the location and extent of distortion in workpiece 302. Sensor component 104 is in communication with controller 106 (not shown). Controller 106 is operatively connected with distortion correction tool 108. Distortion correction tool 108 is used to bring distortions into tolerance by applying force to workpiece 302. Distortion correction tool 108 is comprised of an arm 306 with mount 308. Arm 306 may be a robotic arm and may be articulable. Mount 308 may comprise a tool changer. Distortion correction tool 108 may be articulated through one or more axes. For example, distortion correction tool 108 may comprise, for example, one or more joints, levers, belts, hinges, servomotors, or combinations of such. Mount 308 may be a quick-change mount, such that a tool connected to mount 308 may be removed and replaced on-demand. As shown, the tool may be ram head 310. Ram head 310 may comprise one or more rams 312 which may be hydraulically actuated. Ram 312 is not limited by dimension or geometry, and may be of varying size, weight, and shape. Distortion correction tool 108 may be mobile, fixed, or partially fixed (such as on a track). Distortion correction tool 108 may operate in conjunction with additional distortion correction tools 108.

In one exemplary aspect, it may be determined that ram head 310 is not optimal for bringing distortions into tolerance of workpiece 302. It may be determined that an alternate ram head would be superior in this application. For example, workpiece 302 may have distortions of different severity and scope. Ram head 310 may be suitable for application to a subset of the distortions (those responsive to compressive forces causing plastic deformation), but not all the distortions. As another example, workpiece 302 may comprise a multiple bodies with distortion. A different ram head (or ram heads) may be applied. This may be achieved, for example, by removing ram head 310 from distortion correction tool 108 and replacing it with the alternative ram head. This may involve, for example, use of mount 308 as a quick-change head. Mount 308 may comprise ports such, for example, as hydraulic ports, self-sealing ports, pass-through ports, and may pass, for example, electrical power, electronic communications, and air. Mount 308 may comprise actuators which may comprise sensor component 104. Actuators in mount 308 may sense the force applied by the tool attached to mount 308, and controller 106 may use this to determine the force necessary to correct a distortion induced the workpiece by, in whole or in part, the application of that particular force. Alternatively or additionally, actuators comprising sensor component 104 may also be present in ram head 310 or other quick-change tool heads. As another example, an additional distortion correction tool 108 with an alternative ram head may be utilized. In another exemplary aspect, distortion correction tool 108 is connected with mount 308 in addition to one or more other tools. For example, distortion correction tool 108 may be connected with mount 308 and, additionally, a torch. The torch, for example, may be used in conjunction with distortion correction tool 108. In this way, distortion correction tool 108 may comprise multiple tools, including tools which have additional functions or roles other than for distortion correction. This exemplary aspect may be temporary and may be the result of gripping devices such as, for example, mechanical grippers and pneumatic suction grippers, affixed to distortion correction tool 108. For example, gripping devices may be connected to mount 308 or arm 306.

In another exemplary aspect, distortion correction tool 108 may not have ram head 310 connected with mount 308, and, additionally or alternatively, may not have mount 308 either. Distortion correction tool 108 may engage with fixture 102 and move fixture 102 to a ram. For example, distortion correction tool 108 may have gripper arms which seize fixture 102 and align it with a ram to allow corrective force to be applied to workpiece 302. As another example, distortion correction tool 108 may align fixture 102 within a certain boundary or work area (such as a machining bed). One or more rams may be directed using instructions from controller 106 to the locations of the distortion and apply corrective force while fixture 102 is within the boundary. For example, when fixture 102 is placed on or within a bed, one or more ram heads (which may include ram head 310) may be used to apply corrective force to the distortion using instructions from controller 106.

As corrective force is applied, sensor component 104 may concurrently measure the forces applied and determine whether distortion is being corrected. If distortion is still detected despite applied forces, controller 106 may generate instructions for adjustments to the forces being applied or for additional forces to be applied. For example, sensor component 104 may sense that the forces applied to a distortion have not been corrected by the application of force from ram head 310. Controller 106 may generate instructions for a different or additional distortion correction tool 108 to be applied. For example, ram head 310 may be switched using mount 308 (which may be a quick-change tool mount or head) to a ram head with a smaller or larger diameter bore, or with a different, non-cylindrical geometry. As another example, ram head 310 may be switched using mount 308 to an alternative tool for distortion correction. As another example, ram head 310 may be exchanged for a gripping tool (grippers). The grippers may then be used, for example, to transfer either fixture 102 to a separate tool for distortion correction. For example, fixture 102 may be at some point in a line process. While distortion correction tool 108 may be able to access fixture 102 as it is on the line, other tools may be inaccessible. Distortion correction tool 108 may convey fixture 102 using the grippers to another tool or to a conveyance which may make it accessible to the other tool.

Figure 4:
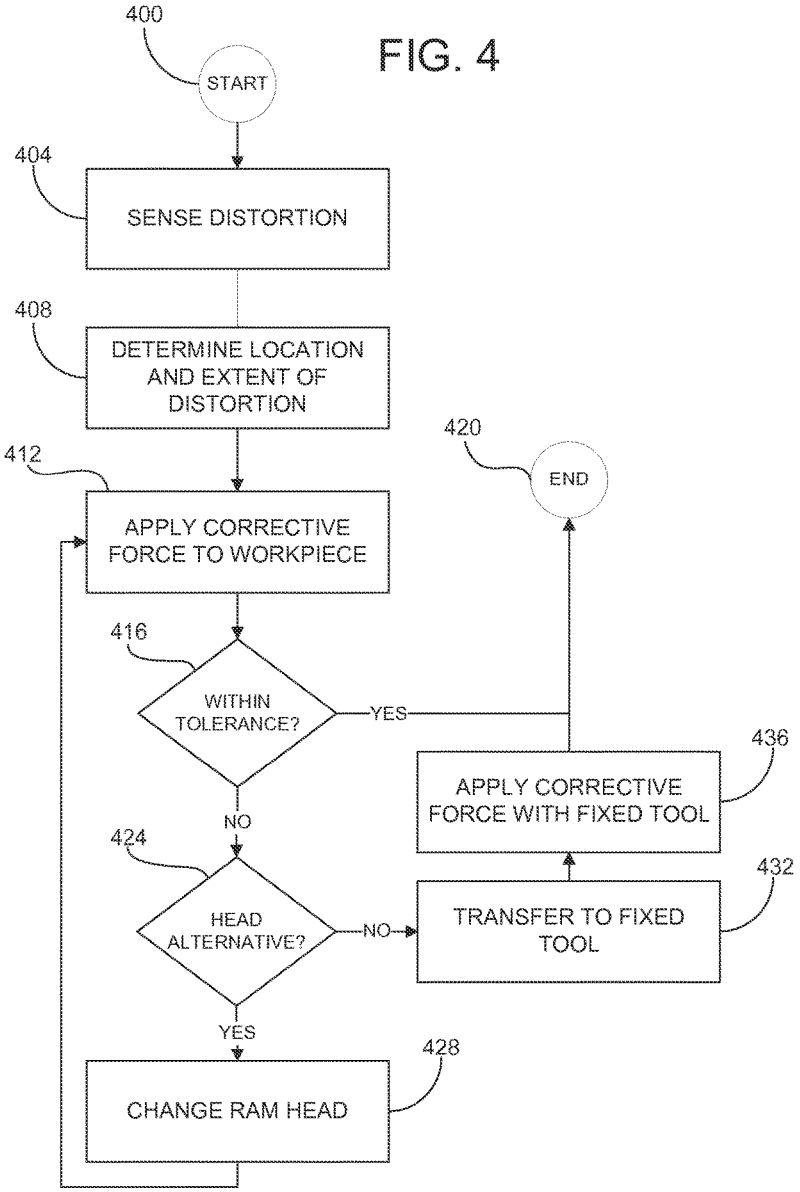
FIG. 4 is an exemplary method of correcting distortions in a workpiece in a smart fixture distortion correction system.

FIG. 4 illustrates an exemplary flowchart of a method of smart fixture distortion correction. At 404, distortion in workpiece 302 is detected by sensor component 104. At 408, the location and extent of the distortion is determined. At 412, corrective force is applied to workpiece 302 using distortion correction tool 108. At 416, sensor component 104 determines whether the distortion is within tolerance. If so, the process concludes at 420. If not, at 424 it is determined by controller 106 whether there is an alternative tool (such as a ram head of a different bore diameter) that can be connected with mount 308 to address the distortion. If so, at 428 ram head 310 is replaced with the alternative tool, and force is applied again at 412. If there is no alternative tool available that can be connected with mount 308 to address the distortion, then at 432 fixture 102 is made accessible to a fixed or static-location tool which is spatially separated from distortion correction tool 108. The fixed-location tool may comprise one or more ram heads of equal or varying diameters. Corrective force may then be applied at 426 to workpiece 302 by the fixed-location tool to correct the distortion. The fixed-location tool at 432 may also be used where alternative tools have been unsuccessfully attempted such that at 424, no unused alternative tools remain available.

Figure 5:
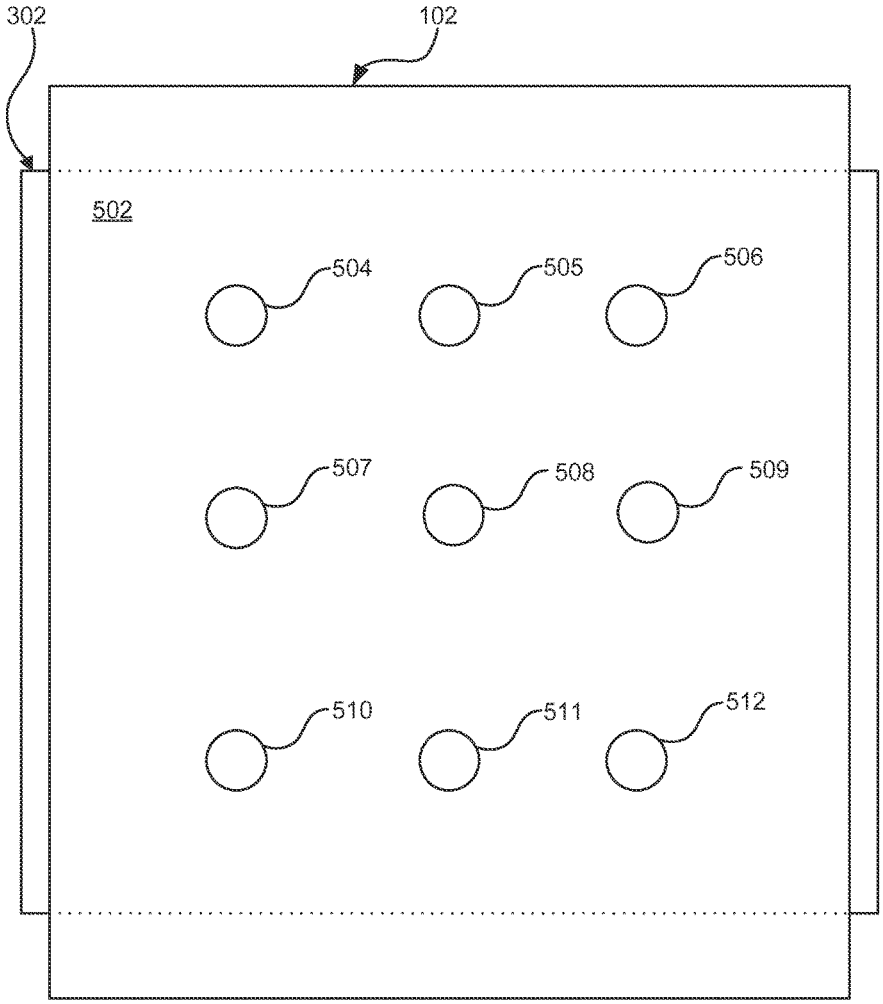
FIG. 5 illustrates an exemplary illustration of a top-down view of a workpiece in an exemplary smart fixture distortion correction system.

FIG. 5 illustrates an exemplary top-down view of a workpiece in an exemplary smart fixture distortion correction system. Workpiece 302 retained by fixture 102 is shown cutaway where it overlaps with fixture 102 (as indicated by the dotted lines). Work area 502 comprises the overlapping area of workpiece 302 and fixture 102. Fixture 102 may have sensors 504, 505, 506, 507, 508, 509, 510, 511, and 512 comprise sensor component 104. The number of sensors and the arrangement of the sensors shown in FIG. 5 is exemplary. Sensors may be 504, 505, 506, 507, 508, 509, 510, 511, and 512 of the same type or design or different types or designs and may be directed to detecting distortion from the one or more of the same or different processes.

The sensors in FIG. 5 may correspond to particular spatial regions. For example, sensor 504 may correspond to a spatial region either exclusive to or overlapping that of sensors 505, 507, and/or 508. The spatial region may be enforced, for example, through operative settings of the sensor(s), range limitations of the sensors, or physical barriers such as locating structures or other bodies.

In one aspect, some sensors may detect distortion of the same type but have different thresholds. For example, sensors 506, 509, and 512 may have a threshold different from that of sensors 504, 505, 507, 508, 510, and 511. This may be because, for example, the portion of workpiece 302 corresponding to the portion of work area 502 covered by sensors 506, 509, and 512 is intended to be distorted, or that distortion of that area is less consequential or inconsequential.

In another aspect, sensors 504, 505, and 506 may correspond to portion of work area 502 where a first weld operation is performed on workpiece 302, sensors 507, 508, and 509 correspond to an area for a second weld operation, and sensors 510, 511, and 512 correspond to an area for a third weld operation. In this aspect, sensor component 104 may comprise load cells and workpiece 302 may comprise a ferrous metal sheet. During and after welding the metal sheet (a weldment) may become distorted due to stresses from localized heating/cooling (non-uniform expansion/contraction or volumetric distortion). It may be determined by controller 106 that distortion is too significant after the first weld operation based on measurements from sensor component 104 and correction must be performed before the second or third operation. After distortion correction, the second weld operation may be performed with a similar determination made by controller 106 based on measurements from sensor component 104 before the third weld operation. Measurements may be timed for after a cooling period after each weld. In this way, workpiece 302 may be worked without cumulative or compounding distortions by correcting distortions incrementally between operations.

Controller 106 may include a general purpose computer or processor that is programmed to perform any of the functions described herein. The controller may be integral to or separate from an engine controller or an overall machine controller. It will be understood that controller 106 may be contained within a single housing or distributed across multiple housings. Further, it will be understood that the controller 106 may perform other functions not described herein. Controller 106 may include components including but not limited to input-output interfaces, electromagnetic interference protection circuitry, backup processors and/or coprocessors, displays, antennas, transceivers, solenoid driver circuitry, converters, analog circuits, programmable logic arrays, application specific integrated circuits, field programmable gate arrays, and other electronic components.

Any of the control functions disclosed herein may be embodied in a non-transient machine-readable medium having instructions encoded thereon for causing the controller or other processor to perform operations according to the coded instructions. The machine-readable medium may include optical disks, magnetic disks, solid-state memory devices, or any other non-transient machine-readable medium known in the art, including non-volatile memory storage media (long-term storage media).

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

INDUSTRIAL APPLICABILITY

The present disclosure is applicable to detecting, assessing, locating, and correcting distortions in workpieces. The use of a smart fixture distortion correction system as described herein allows for more efficient, accurate, and reliable detection and correction of distortions in workpieces. This allows for quicker, more streamlined inspection and testing processes for workpieces, decreasing the scrap and rejection rate. This is particularly valuable in high-volume production situations. Furthermore, systems and devices which the workpiece is ultimately integrated with may be better protected from failure.

A smart fixture distortion correction system is also flexible. Scrap, rejection, and failure are ubiquitous concerns for manufacturers. The sensor component is applicable to fixtures holding workpieces subjected to varying types of processes, either individually or in combinations. This desirable feature allows for the detection, locating, and correction of distortions of different types introduced into workpieces of diverse attributes with varying tolerances.

Additionally, productivity gains may be achieved where existing distortion testing and correction relies on blind, uniform corrective actions. A smart fixture distortion correction system is able to locate distortions and direct corrective force to just those locations. Furthermore, the corrective force applied is more reliable in bringing distortions within tolerances because the forces which induced those distortions are measured and can be used to tailor the corrective force being applied accordingly. Blanket approaches to corrective actions may not only be inefficient because they are checking areas for distortions which are not distorted, but also may introduce stresses into workpieces through the unselective application of force to the workpieces.

This also extends to the selection of tools for correcting distortions. A smart fixture distortion correction system may have multiple options for tools to be selected from and efficiently switched between or used in conjunction. The system determines, based on what is sensed, the most effective tool available, and is also able to adapt when the selected tool does not correct the distortion in whole or in part. This desirable feature allows for the efficient correction of distortions of varying magnitudes and types not provided by conventional correction techniques.

The many features and advantages of the disclosure are apparent from the detailed specification, and, thus, it is intended by the appended claims to cover all such features and advantages of the disclosure which fall within its true spirit and scope. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

We claim:

1. A fixture system for correcting a distortion of a workpiece comprising:

a fixture;

a sensor component operatively coupled to the fixture, the sensor component including a load cell;

a long-term storage medium; and a controller communicatively connected with the long-term storage medium, the controller effectuating instructions comprising:

receiving, from the sensor component, a first measurement of a workpiece held by the fixture, wherein the first measurement comprises a magnitude of a process force applied to the workpiece, and a second measurement of the workpiece, wherein the second measurement comprises a magnitude of a distortion of the workpiece and a location of the distortion;

determining that the second measurement is not within a tolerance; and responsive to the determining that the second measurement is not within the tolerance, directing a correction tool in communication with the controller to apply a first corrective force to the workpiece at the location indicated by the first measurement, wherein the magnitude of the first corrective force is based on the magnitude of the distortion indicated by the first measurement.

2. The fixture system of claim 1, wherein the sensor component further includes at least one of a temperature sensor, an actuator, a force sensor, a gas sensor, an accelerometer, a distance sensor, a linear position sensor and a rotary position sensor.

3. The fixture system of claim 1, wherein the fixture further comprises a supporting structure, and wherein the sensor component is integral to the supporting structure.

4. The fixture system of claim 1, wherein the first measurement is indicative of a volumetric distortion.

5. The fixture system of claim 1, wherein the correction tool comprises a ram head, and wherein the first corrective force comprises a compressive force.

6. The fixture system of claim 1, wherein the workpiece comprises a weldment.

7. The fixture system of claim 1, wherein the sensor component is integral to the fixture and the sensor component is at least partially enclosed within a body portion of the fixture.

8. The fixture system of claim 1, further including a distortion correction identifier device associated with the workpiece, wherein the distortion correction identifier device is capable of receiving and storing measurements from the sensor component, and wherein the controller provides the distortion correction identifier device with information about the first corrective force applied to the workpiece.

9. The fixture system of claim 1, wherein the controller further performs the steps of:

responsive to the first corrective force applied by the correction tool to the workpiece at the first location, receiving, from the sensor component, a third measurement, wherein the third measurement comprises the magnitude of the distortion of the workpiece at the location;

determining that the third measurement is not within the tolerance level; and directing the correction tool to apply a second corrective force to the workpiece at the location, wherein the magnitude of the second corrective force is based on the first measurement and the second measurement.

10. The fixture system of claim 9, wherein the correction tool comprises a ram head and the first corrective force and the second corrective force each comprise compressive forces.

11. A method of correcting distortion in a workpiece comprising:

responsive to the application of a process force to a workpiece held by a fixture, sensing, by a sensor component including a load cell and operatively coupled to the fixture, a first measurement of the workpiece held by the fixture, the first measurement comprising a magnitude of the process force;

sensing, by the sensor component, a second measurement of the workpiece, the second measurement comprising a magnitude of a distortion of the workpiece induced by the process force;

determining, by a controller communicatively coupled to the sensor, that the second measurement is not within a tolerance level;

selecting, by the controller, based on the first measurement, a correction tool for bringing the distortion within the distortion tolerance; and directing, by the controller, the correction tool to apply a first corrective force to the workpiece, wherein the magnitude of the first corrective force is determined based on the first measurement.

12. The method of claim 11, wherein the correction tool is coupled with a torch, and wherein directing the correction tool to apply the first corrective force further includes directing the torch to apply a heat treatment.

13. The method of claim 11, wherein the fixture further comprises a locating structure, and wherein the sensor component is integral to the locating structure.

14. The method of claim 11, wherein the second measurement is indicative of a volumetric deformation of the fixture.

15. The method of claim 11, wherein the correction tool comprises a ram head, and wherein the corrective force comprises a compressive force.

16. The method of claim 11, further comprising:

responsive to the application of the first corrective force by the correction tool to the workpiece, sensing, by the sensor component, a third measurement, wherein the third measurement comprises the magnitude of the distortion of the workpiece at the location;

determining that the third measurement is not within the tolerance level; and directing the correction tool to apply a second corrective force to the workpiece at the location, wherein the magnitude of the second corrective force is based on the third measurement.

17. A computer-readable storage medium comprising executable instructions that when executed by a processor cause the processor to effectuate operations comprising:

receiving, from a sensor component including a load cell and operatively coupled to a fixture, a first measurement of a workpiece held by the fixture, wherein the first measurement comprises a first indication of a volumetric distortion of a first location of the workpiece, and wherein the first measurement is generated responsive to a weld of the workpiece;

determining that the first measurement is not within a tolerance; and responsive to determining that the first measurement is not within the tolerance, directing a correction tool in communication with the controller to apply a compressive force to the first location, the magnitude of the force based on the volumetric displacement of the first location.

18. The method of claim 17, wherein the tolerance is received from a radio-frequency identification tag detachably coupled to the fixture.

19. The method of claim 17, wherein the correction tool comprises a hydraulically-actuated ram head.

20. The method of claim 17, the operations further comprising:

receiving, from the sensor component, a second measurement responsive to the compressive force from the correction tool, wherein the second measurement comprises a second indication of the volumetric displacement of the first area of the workpiece;

determining that the second measurement is not within the tolerance; and responsive to determining that the second measurement is not within the tolerance, directing the correction tool to apply a compressive force to the first area, the magnitude of the force based on the volumetric displacement of the first area of the workpiece.

* * * * *